US005649703A

United States Patent [19]

Kanbar

[11] Patent Number: 5,649,703

[45] Date of Patent: Jul. 22, 1997

[54] CUBIST PUZZLE CARTRIDGE

[76] Inventor: Maurice S. Kanbar, 2140 Pacific Ave., San Francisco, Calif. 94115

[21] Appl. No.: 558,732

[22] Filed: Nov. 16, 1995

[51] Int. Cl.[6] ..... A63F 9/10

[52] U.S. Cl. ..... 273/157 R; 273/160

[58] Field of Search ..... 273/156, 157 R, 273/160, 153 R

[56] References Cited

U.S. PATENT DOCUMENTS

| | | | |
|---|---|---|---|
| 1,257,655 | 2/1918 | Walden | 273/157 R |
| 1,337,178 | 4/1920 | Swerer | 312/283 |
| 1,987,496 | 1/1935 | Springborn | 273/157 R |
| 1,997,501 | 4/1935 | Sweney | 273/157 R |
| 2,984,489 | 5/1961 | Parlato | 273/157 R |
| 3,410,021 | 11/1968 | Patterson | 273/160 |
| 3,546,792 | 12/1970 | Sherman | 273/160 |
| 4,298,200 | 11/1981 | Kanbar | 273/157 R |
| 5,393,063 | 2/1995 | Ichimaru | 273/160 |

*Primary Examiner*—Steven Wong
*Attorney, Agent, or Firm*—Michael Ebert

[57] ABSTRACT

A cartridge housing a cubist puzzle game having a set of polycube pieces and a deck of playing cards associated with the set. Each polycube piece is formed by at least three like cubes joined together in a common plane in various ways to define the geometry of the pieces. When these piecess are intermeshed in a common plane, they then form a rectangular pad. When otherwise interfitted, the polycube pieces then create multiplanar cubist figures whose configuration depend on how the pieces are interfitted. Each playing card displays on one face a reproduction of a particular cubist figure which constitutes a puzzle in that the relationship between the interfitting pieces is not apparent in the reproduction. The opposite face of the card displays this relationship and, therefore, a solution to the puzzle. The cartridge is provided with a rectangular frame divided into a first open compartment for accommodating the pad of pieces and an opposing second open compartment for accommodating the deck of cards. Hinged to one side of the frame is a lid to close the first open compartment, and hinged to the opposing side is a lid to close the second open compartment. One of the lids has a slot therein to socket a playing card to display the reproduced cubist figure which a player in order to recreate, must interfit the pieces in a particular way.

5 Claims, 4 Drawing Sheets

FIG. 1A
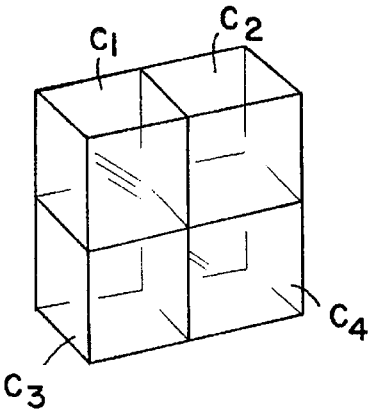
FIG. 1B
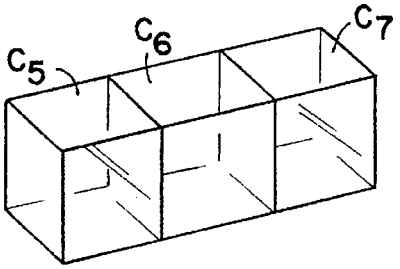
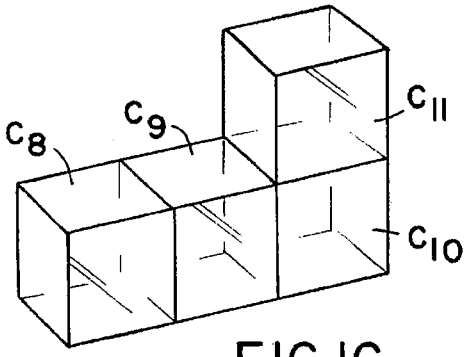
FIG. 1C
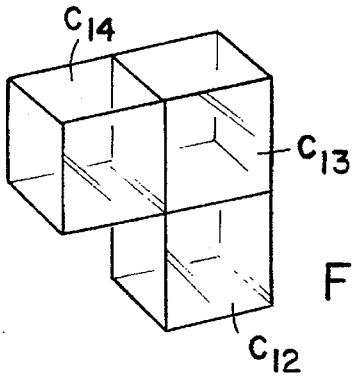
FIG. 1D
FIG. 1E
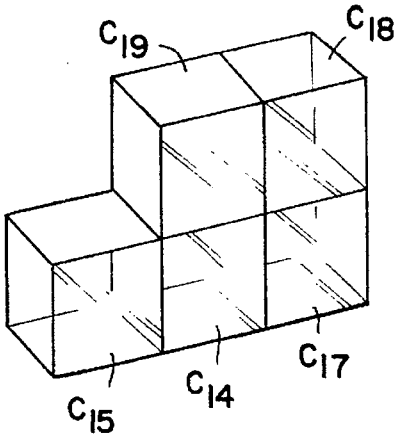
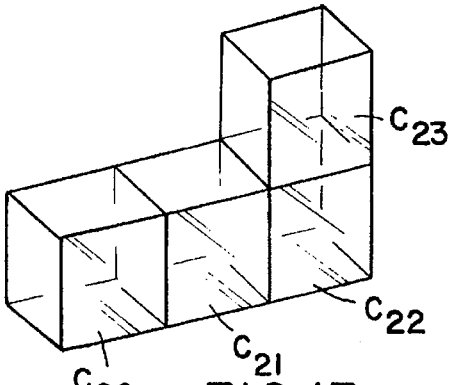
FIG. 1F
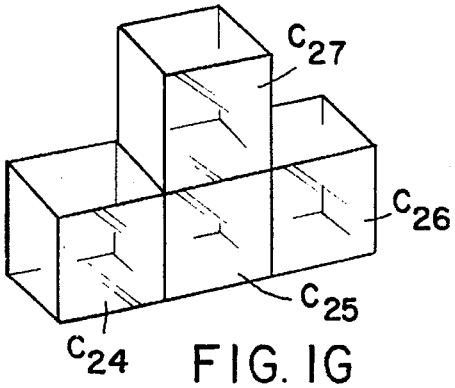
FIG. 1G

CUBIST PUZZLE CARTRIDGE

BACKGROUND OF INVENTION

1. Field of Invention

This invention relates generally to a cubist puzzle game playable with a set of geometric pieces and a deck of playing cards each displaying a reproduction of a cubist figure to be recreated by interfitting the pieces, and more particularly to a compact cartridge for housing both the set of pieces and the deck of playing cards.

2. Status of Prior Art

Puzzle games are known which provide a player with a set of pieces having different geometric forms, such that when the pieces are interfitted in various ways, abstract figures are created whose configuration depend on how the pieces are interfitted.

Thus a Tangram puzzle consists of seven geometric pieces derived from a large square. A Tangram set is made up of two large triangles, two small triangles and a medium-sized triangle, plus a small square and a rhomboid. From these pieces the player is able to create figures that may be abstract or representational in form. In practice, the player can create silhouetted humanoid or animal-like figures in various postures as well as silhouetted bridges, houses or other architectural configurations.

Applicant's prior U.S. Pat. No. 4,298,200 (Kanbar) discloses a Tangram game assembly constituted by two sets of Tangram pieces capable of creating a variety of geometric or representational figures. Also included is a deck of cards, each having printed on its front face a Tangram puzzle figure, the solution to this puzzle being printed on the reverse face of the card. In play, a card is withdrawn from the deck and its front face presented to the players who with their respective sets of pieces then race to recreate the figure.

The Kanbar game assembly is housed in a case having a closed end and an open end, the case having a partition therein to define in conjunction with the closed end, a compartment to receive two sets of Tangram pieces, and to define in conjunction with the open end, a compartment to accommodate the deck of cards. A removable cover is provided which fits over the case, the cover having a closed end and an open end, the cover thereby locking in the card deck. In the playing mode, the cover position is reversed to expose one end of the card deck to permit withdrawal of cards therefrom one at a time. The cover also includes a transverse slot acting as socket for the withdrawn card so that the card may be presented in an upright position to the players.

A Tangram game is made up by two-dimensional flat pieces all occupying a common plane. The configuration of the abstract figures created by interfitting these pieces is also two-dimensional. A puzzle game in accordance with the invention is based on the art of cubism which originated in Paris in 1907. Cubism is represented in the works of such famous artists as Picasso and Braque. In cubism, a three-dimensional subject which can be a human figure, a landscape, a mandolin or any other subject, is fragmented and redefined within several interlocking planes to create a rigidly geometric abstract form free of curves.

Underlying the art of cubism is the geometry of a cube which is a solid bounded by six equal square faces whose adjacent faces are perpendicular to each other. Thus a three-dimensional cubist work of abstract sculpture appears to be largely composed of interlocking cubes.

In a cubist puzzle game in accordance with the invention, the player is provided with a set of play pieces each being a polycube piece formed by at least three like cubes joined together in a common plane to define the geometry of the pieces. Thus if the piece is formed by a row of three intermeshed cubes, with a fourth cube stacked above the third cube in the row and joined thereto, the piece will then have the geometry of an "L." But if the fourth cube is stacked above the second cube in the row and joined thereto, the piece will then have a T-shaped geometry.

The player is also provided with a deck of cards, each carrying on its front face a reproduction of a multi-planar cubist figure whose configuration is determined by the manner in which the polycube pieces of the set are interfitted. However in the reproduced figure, the cubes which constitute the figure all appear to be joined together. Hence the reproduced cubist figure does not reveal the interfitting relationship of the polycube pieces while together compose the figure. It is this interfitting relationship which constitutes the puzzle presented to the player.

In order therefore for a player to solve the puzzle, he must interfit the polycube pieces of the set so as to recreate the cubist figure displayed on the playing card. And he must succeed in doing so within specified time limits. A player, therefore, in order to succeed, must exercise his visual imagination in regard to geometric forms and how these forms develop different abstract cubist configurations, depending on how they are combined.

In a sense, a player of the cubist puzzle game is confronted with a problem similar to that faced by Michelangelo who sought to transmute a massive block of marble into a sculptured figure. Michelangelo is reputed to have remarked that this is an easy task, for the artist had only to imagine that a scultured figure is imprisoned within the block. All that is then necessary is for the artist to chisel away the marble to release the figure form the block.

But it is no easy task for a player of the cubist puzzle game, lacking Michelangelo's extraordinary imagination, to interfit the geometric pieces of the set to recreate an abstract cubist figure reproduced in a playing card. If therefore, the player fails in the attempt within specified time limits, he can then consult the rear face of the playing card which presents the solution to the puzzle, for it shows the relationship of the pieces and how they are to be interfitted to recreate the reproduced figure.

It is known in the prior art to provide a puzzle making use of interfitting polycube pieces. A puzzle of this type as indicated in the text "Creative Puzzles of the World" by Pieter Van Deft and Jack Botermans, was invented by the noted puzzles inventor Piet Hein, the puzzle being known as the SOMA CUBE.

A SOMA CUBE puzzle makes use of seven polycube pieces, each formed by three or four like cubes which are interconnected, some in a common plane, others in two planes, but in no instance in a straight line. Thus one piece is formed by first and second cubes in end-to-end relation and a third cube stacked above the first cube so that all cubes lie in a common plane. In another piece, first and second cubes are joined together in a horizontal plane, and third and fourth cubes are joined together in a vertical plane, the third cube being joined to the first cube to form a piece occupying two planes.

The polycube pieces of the SOMA CUBE can be interfitted by a player to create multi-planar cubical figures. One significant distinction between a SOMA CUBE and a cubist puzzle in accordance with the invention is that in the former the pieces are made up of polycubes some of which lie in a common plane and others in two planes, whereas in the latter cubes, which form the seven pieces, all lie in the same plane.

With a set of seven pieces in accordance with the invention, the pieces can be interfitted to create in the storage mode of the game a rectangular pad that can be seated in a cartridge. The seven pieces of the SOMA CUBE cannot be so interfitted.

Another distinction between a SOMA CUBE and a cubist puzzle in accordance with the invention is that the pieces of the former are formed by three and four cubes, whereas in the latter the pieces are formed of three, four and five cubes.

SUMMARY OF INVENTION

The main object of this invention is to provide a cartridge for housing the set of polycube pieces of a cubist puzzle as well as a set of playing cards associated with the puzzle, the cartridge serving to compactly store the set of pieces and the deck of cards, and also to make them readily available for play activity.

More particularly, the object of this invention is to provide a cartridge of the above type in which the set of stored pieces are intermeshed to form a rectangular pad that is received in one open compartment of the cartridge, the deck of cards being received in another open compartment thereof.

A significant feature of a cartridge in accordance with the invention is that it includes a slot to socket a playing card and support it in an upright position whereby a player is presented with a reproduction of the cubist figure which the player must recreate from the pieces of the puzzle.

Also an object of this invention is to provide a cartridge of the above type formed of interhinged sections, so that no section can be misplaced or misaligned when manipulating the cartridge to store therein the set of play pieces and the deck of card, or to remove these pieces and the cards in order to play the game.

Briefly stated, these objects are attained by a cartridge housing a cubist puzzle game having a set of polycube pieces and a deck of playing cards associated with the set. Each polycube piece is formed by at least three like cubes joined together in various ways to define the geometry of the pieces. When these pieces are intermeshed in a common plane, they then form a rectangular pad. When otherwise interfitted, the pieces then create cubist figures whose configuration depends on how the pieces are interfitted. Each playing card on one face displays a reproduction of a particular cubist figure which constitutes a puzzle in that the relationship between the interfitting components is not apparent in the reproduction. The opposite face of the card displays this relationship and, therefore, a solution to the puzzle.

The cartridge is provided with a rectangular frame divided into a first open compartment for accommodating the pad of pieces and an opposing second open compartment for accommodating the deck of cards. Hinged to one side of the frame is a lid to close the first open compartment, and hinged to the opposing side is a lid to close the second open compartment. One of the lids has a slot therein to socket a playing card to display the reproduced cubistic figure which a player in order to recreate, must interfit the pieces in a particular way.

BRIEF DESCRIPTION OF DRAWINGS

For a better understanding of the invention as well as other objects and further features thereof, reference is made to the following detailed description to be read in conjunction with the accompanying drawings, wherein:

FIGS. 1A to 1G illustrate a set of seven polycubes for playing a cubist puzzle game in accordance with the invention;

DETAILED DESCRIPTION OF INVENTION

The Cubist Puzzle Game

Figure 3A:
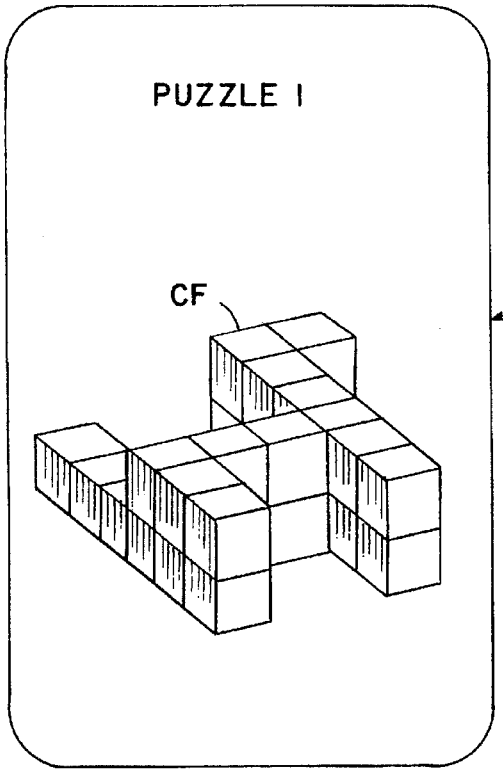
FIGS. 3A and 3B illustrate the opposite faces of one playing card in a deck thereof associated with the puzzle game.

In a two-dimensional tangram game, the geometric pieces are produced by dividing a square plate into geometric pieces of different shape. These Tangram pieces can be interfitted to recreate the square plate from which they are derived, or they may be interfitted to create abstract geometric forms.

In a three-dimensional cubist puzzle game in accordance with the invention, the basic elements are like cubes each having six faces. In practice each face may be a ¾ inch square, so that the cube itself is tiny. These cubes, when assembled in a common plane, then form a rectangular pad, such as a pad which is three cubes in width and nine cubes in length, the total number being 27 cubes. Then the rectangular pad is dissected into polycubes each having at least three cubes which are joined together to create a set of geometric cubes whose shapes depend on how the cubes forming the polycube are joined together. Or the rectangular pad may be formed from 5 cubes in width and 11 cubes in length, so that the total number of cubes in the rectangular is 55.

The geometric polycube pieces derived from the rectangular pad can be intermeshed in a common plane to recreate the rectangular pad. Or they can be otherwise interfitted in more than one plane to create abstract cubist figures whose configurations depend on the relationship of the interfitted polycubes.

FIGS. 1A to 1G separately illustrate the seven polycubes play pieces which together create the set of geometric pieces for playing the cubist puzzle game.

The polycube pieces are each formed by at least three like six-sided cubes which are bonded together at adjacent sides in such a way as to create a desired geometric piece. The cubes may be made of transparent synthetic plastic material such as acrylic resin or polypropylene so that the cubes are glass-like in appearance. In practice, the pieces may be color coded, so that one polycube piece has a yellow hue, another is red-hued and so on. Hence each piece may be recognized by its distinctive color.

The polycube piece represented by FIG. 1A is formed of a pair of cubes $C_1$ and $C_2$ and a pair of cubes $C_3$ and $C_4$ stacked above the first pair, all of the cubes being bonded together at their adjacent faces with a clear adhesive to create a geometric component that has the shape of a rectangular slab.

The polycube piece represented by FIG. 1B is formed by a row of three interbonded cubes $C_5$, $C_6$, and $C_7$ in end-to-end relation to form a component having a bar-like geometry. The piece represented by FIG. 1C is formed by three cubes $C_8$, $C_9$ and $C_{10}$ in a row and a fourth cube $C_{11}$ on top of cube $C_{10}$ to create a piece having the geometry of an "L".

The polycube piece represented by FIG. 1D is composed of a cube $C_{12}$, a cube $C_{13}$ stacked above cube $C_{12}$ and a cube $C_{14}$ joined to one side of cube $C_{13}$ to form a piece having a right-angled geometry. The piece represented by FIG. 1E is formed by cubes $C_{15}$, $C_{16}$ and $C_{17}$ in a row, and cubes $C_{18}$ and $C_{19}$ stacked above cubes $C_{16}$ and $C_{17}$ to create a component whose geometry is that of a rectangular slab having an end projection. The polycube pieces represented by FIG. 1F is formed by cubes $C_{20}$, $C_{21}$, $C_{22}$ and $C_{23}$ and has the same L-shaped geometry as the FIG. 1C piece. And the piece represented by FIG. 1G is formed by three cubes $C_{24}$, $C_{25}$, $C_{26}$ in a row, with a cube 27 above cube $C_{25}$ to form a piece having a T-shaped geometry. All of the polycubes lie in the same plane.

Figure 2:
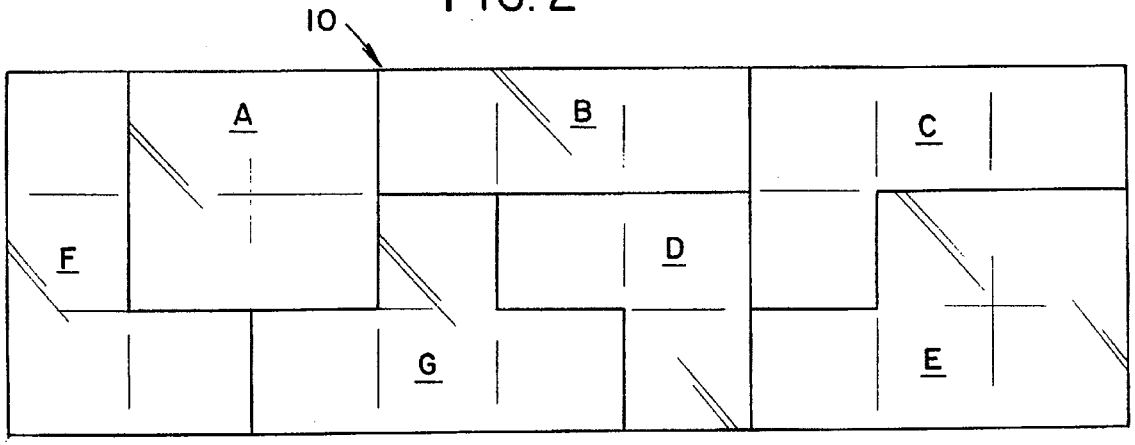
FIG. 2 shows the seven play pieces when interfitted in a common plane to form a storable rectangular pad.

The respective geometries of the seven pieces illustrated in FIGS. 1A to 1G are such that these components can be intermeshed in a common plane as shown in FIG. 2 so that they form a rectangular pad 10. In FIG. 2; each piece (A and G) shown therein corresponds to the respective polycubes shown in FIGS. 1A to 1G. But in FIG. 2, the cubes which together form the components are not shown, for one only sees the overall geometry of the pieces.

The rectangular pad illustrated in FIG. 2 represents the storage mode of the seven polycube pieces which make up the set, for in this mode, the set may be stored in a compartment of a cartridge as well later be explained.

Playing the Cubist Game

To play the cubist puzzle game, the player is presented with a playing card which displays a reproduced three-dimensional multi-planar cubist figure formed of the polycubes which make up the set of seven pieces.

The player seeing this reproduced cubist figure is presented with a puzzle, for in the reproduced figure, the polycubes which make up the figure all appear to be interconnected and there is nothing to indicate which cubes belong to the respective geometric components of the set. Hence a player looking at a cubist figure displayed on a playing card is given no hint as to how the seven geometric pieces A to G of the set must to be interfitted in more than one plane to recreate the figure.

The player of the cubist puzzle game is provided not only with the set 10 of seven geometric pieces, but also with a deck of playing cards.

FIG. 3A (Puzzle I) shows the front face of one such playing card 11 on which is reproduced a cubist figure CF formed by the seven interfitting pieces of the set. But in this cubist figure, the polycubes which compose the figure all appear to be interconnected and there is nothing in the reproduced figure which separately delineates the seven polycube pieces and how they are interfitted. Hence the puzzle the player is called upon to solve is how to interfit the seven polycube pieces to recreate the reproduced cubist figure, for there is only a particular relationship of these pieces that will solve the puzzle.

Figure 3B:
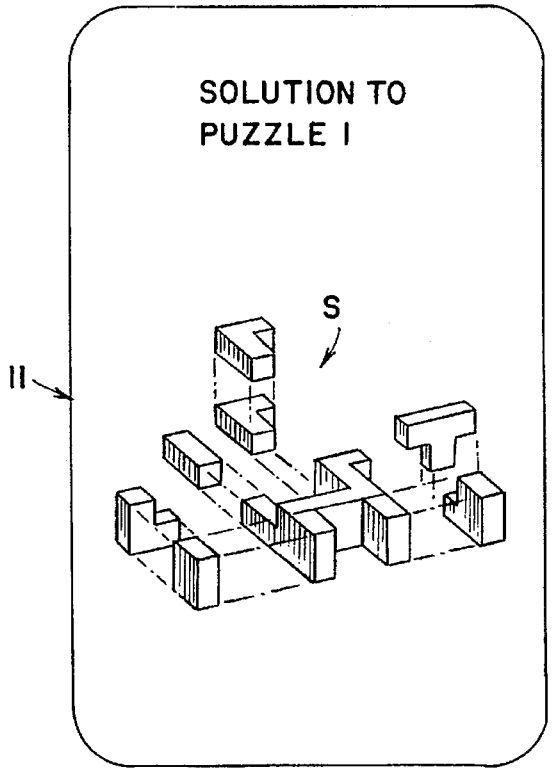

Should the player fail to come up with a solution within the time period allotted to him by the rules of the game, he can then consult the rear face of the card 11 which as shown in FIG. 3B carries the solution S to the puzzle. In FIG. 3B, the set of geometric pieces are separately shown in their proper relationship with dotted lines indicating how the pieces are to be interfitted to recreate the cubist figure shown in FIG. 3A.

Figure 4A:
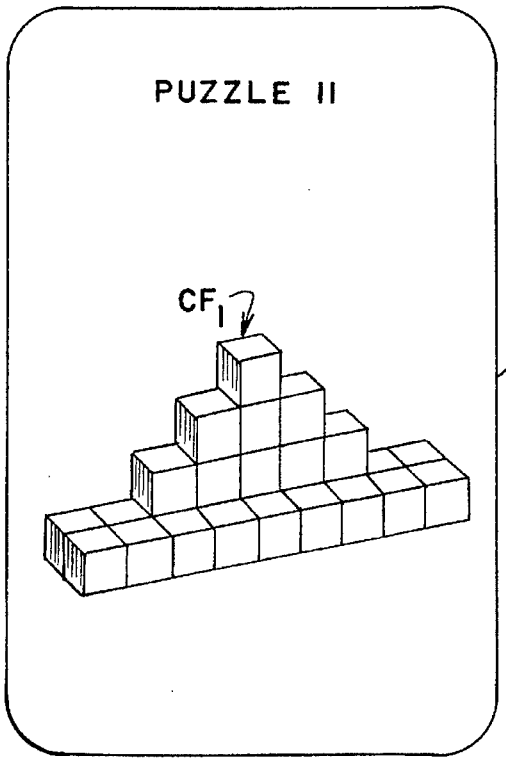
FIGS. 4A and 4B illustrate the opposite faces of another playing card.
Figure 4B:
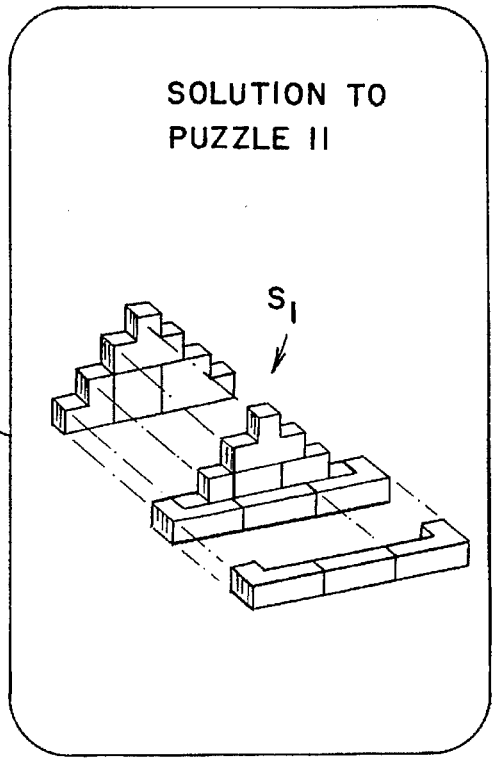

FIGS. 4A and 4B show another puzzle card 12 (Puzzle II) FIG. 4A shows the puzzle figure $CF_1$ on one face of the card, and FIG. 4B shows the solution $S_1$ on the opposite face.

The Cartridge

A cartridge in accordance with the invention provides a compact package for the set of geometric pieces and the deck of playing cards which together form the cubist puzzle game. And the cartridge also functions to facilitate playing the game, for it presents to the player in an upright position, card to be played.

Figure 5:
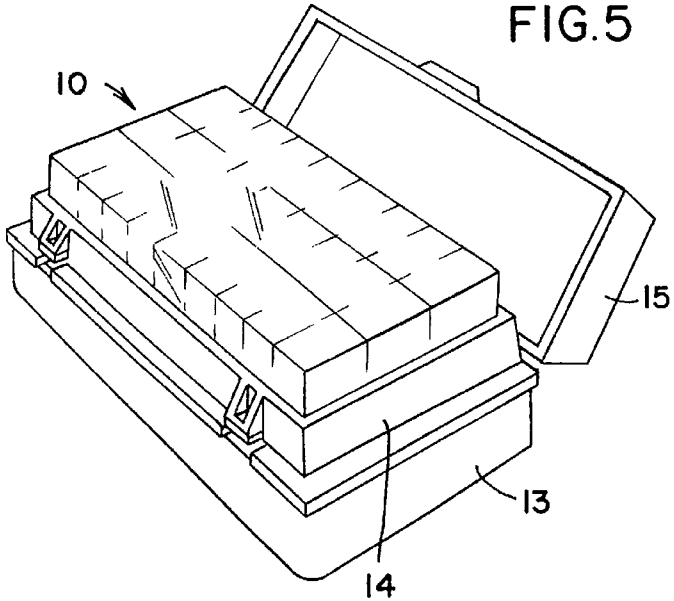
FIG. 5 is a perspective view of a cartridge in accordance with the invention for housing in one compartment the set of play pieces and in another compartment the deck of playing cards; the lid of the play piece compartment being swung open to expose the play pieces.

The cartridge, as shown in FIG. 5, generally identified by reference numeral 13, includes an open rectangular compartment 14 which accommodates the rectangular pad 10 formed by the intermeshed seven pieces of the set. This pad is the storage mode of the set and in order to play with the pieces, they must be removed from compartment 14 which is normally closed by a hinged lid 15.

Figure 6:
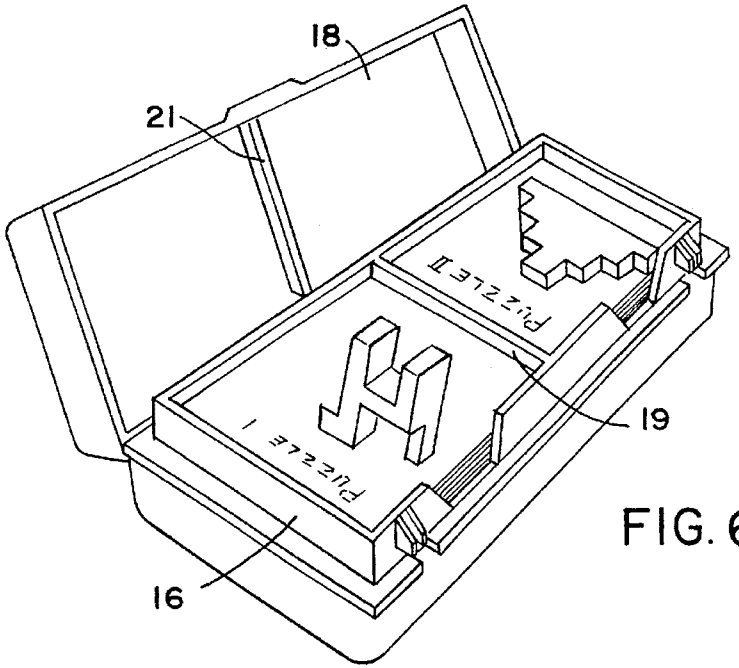
FIG. 6 shows the same cartridge turned around with the lid of the playing card compartment being swung open to expose the cards.

Also provided is an open rectangular compartment 16, as shown in FIG. 6, which is closed by a hinged lid 18. Compartment 16 is divided by a partition 19 into two like sections in which are nested the cards 20 of the deck of playing cards.

Figure 7:
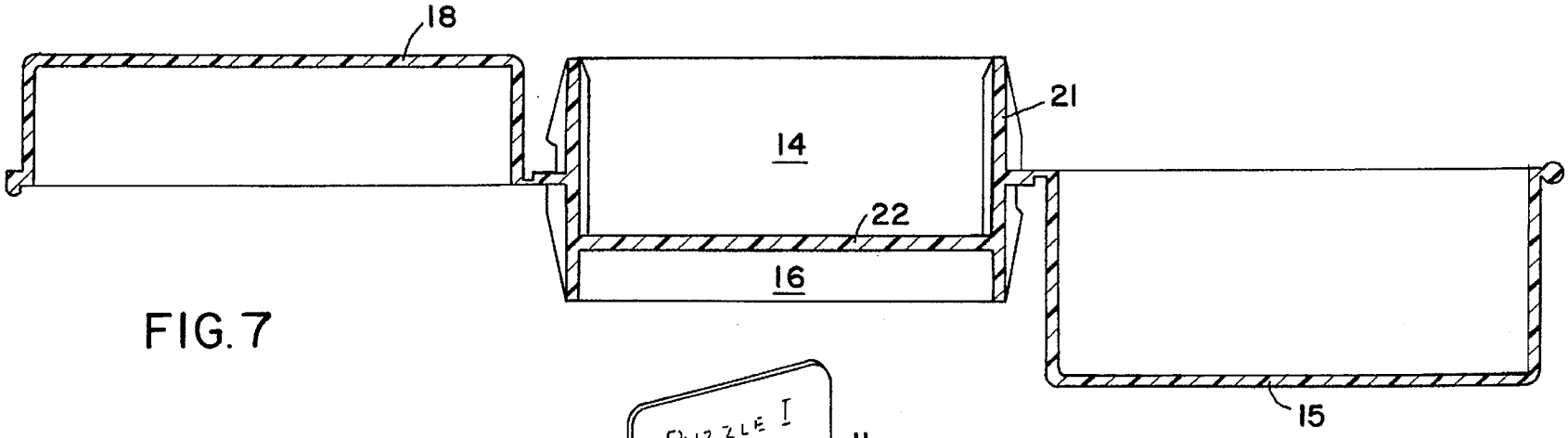
FIG. 7 is a transverse section taken through the cartridge with its two lids swung open.

As shown in FIG. 7, the cartridge is provided with a rectangular central frame 21 which is divided by a single partition 22 into the upper compartment 14 in which the set of play pieces is nested, and the lower compartment 16 in which the deck of playing cards is nested. The lid 15 for closing upper compartment 14 is hinged to one long side of the frame, preferably by a living hinge. The lid 18 for closing the lower compartment 16 in which the playing cards are nested is hinged to the opposite long side of the frame. Hence when both lids are closed, the cartridge has the appearance of a rectangular box.

When one wishes to play the puzzle game, one first open lid 15 to remove the play pieces from compartment 14, and then close the lid over the empty compartment. Then one turns over the cartridge and opens lid 18 to remove the deck of cards, after which this lid is closed, so that the cartridge is now completely empty.

Figure 8:
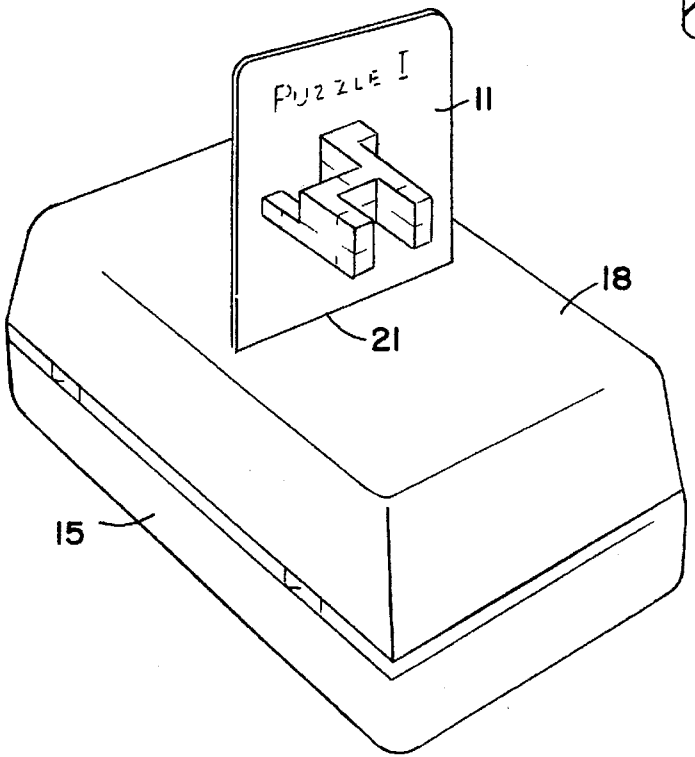
FIG. 8 shows the closed cartridge with a playing card socketed in a slot on the lid of the playing card compartment.

It will be seen in FIGS. 6 and 8 that lid 18 is provided at its center with a transverse slot 23. This slot acts as a socket to receive one of the playing cards and hold it in an upright position so that a player can see only the front face of the card on which is printed a reproduction of the cubist figure the player is required to recreate by interfitting the pieces of the set. The player only consults the opposite side of the card if he wishes to know the solution to the puzzle.

While there has been shown a preferred embodiment of the invention, it will be appreciated that many changes may be made thereon without departing from the spirit of the invention.

I claim:

1. A cartridge in combination with a cubist puzzle game constituted by a set of play pieces and a deck of playing cards, each piece in the set being formed by a plurality of like cubes joined together in a common plane to define a geometric polycube piece which when intermeshed with the other polycube pieces in the set in a common plane then define a planar rectangular pad, and when interfitted with the other pieces in multiple planes then create a cubist figure whose configuration depends on the interfitting relationship of the pieces, each playing card in the deck displaying on its front face a reproduction of a particular cubist figure formed by the interfitting pieces without revealing their relationship, said cartridge having a first open compartment in which said pad is nested and a second open compartment accommodating said deck of cards, said cartridge being formed by a rectangular frame partitioned to define said first open compartment at the upper end thereof and said second open compartment at the lower end thereof, a first lid hinged to one side of the frame to close the upper compartment and a second lid hinged to the opposite side of the frame to close the lower compartment.

2. A cartridge as set forth in claim 1, in which each card on its rear face displays the interrelationship of the pieces necessary to create the figure shown on the front face.

3. A cartridge as set forth in claim 1, in which said rectangular pad is composed of twenty-seven cubes in a three cube by nine cube array, each polycube pieces of said pad being formed of at least three cubes.

4. A cartridge as set forth in claim 1, in which the lower compartment lid is provided with a transverse slot to socket the card to be played and support it in an upright position.

5. In combination,

A. a cartridge formed by a rectangular frame partitioned to define an open upper compartment and an open lower compartment, said frame having hinged to one side thereof a lid to close the upper compartment and having hinged to the other side thereof a lid to close the lower compartment;

B. a set of intermeshing polycube play pieces defining a rectangular pad received in said upper compartment; and C. a deck of playing cards received in said lower compartment, each card in the deck displaying on its front face a reproduction of a particular cubist figure formed by interfitting the play pieces without revealing their relationship.

* * * * *